US006375313B1

(12) United States Patent
Adavikolanu et al.

(10) Patent No.: US 6,375,313 B1
(45) Date of Patent: Apr. 23, 2002

(54) ORIFICE PLATE FOR INKJET PRINTHEAD

(75) Inventors: Srinivas Adavikolanu, Hillbrooks; Kok Leong Lim, Singapore, both of (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/756,990

(22) Filed: Jan. 8, 2001

(51) Int. Cl.[7] ..... B41J 2/05
(52) U.S. Cl. ..... 347/63
(58) Field of Search ..... 347/63, 56, 64, 347/61, 54; 216/27, 4; 29/890.1; 430/311, 281.1

(56) References Cited

U.S. PATENT DOCUMENTS 4,694,308 A 9/1987 Chan et al.

4,829,319 A 5/1989 Chan et al.

*Primary Examiner*—Raquel Yvette Gordon

(57) ABSTRACT

A process for forming an orifice plate for a thermal inkjet printhead involves the use of a photoimageable polymer and photolithography for forming a plastic orifice plate having a defined pattern of orifices therein. A substrate is used to support a photoimageable polymer layer (which ultimately becomes the orifice plate) during the photolithographic steps, which preserves the structural integrity of the polymer layer. The process allows high accuracy in the dimensioning, spacing and shaping of the orifices. A thermal inkjet print head assembly is also disclosed which involves bonding the plastic orifice plate to a polymer barrier layer of a thin film resistor heater structure using heat and pressure.

15 Claims, 6 Drawing Sheets

ORIFICE PLATE FOR INKJET PRINTHEAD

TECHNICAL FIELD

The present invention relates to thermal ink jet printing and more particularly to the manufacture of a plastic orifice plate for an inkjet printhead assembly, manufacture of an inkjet printhead assembly, provision of a plastic orifice plate and provision of an inkjet printhead assembly.

BACKGROUND

In thermal inkjet printing, localised heat transfer to a defined volume of ink, which is located adjacent to an ink jet orifice, vaporises the ink and causes it to expand thereby ejecting the ink from the orifice during the printing of characters on a print medium. The defined volume of ink is usually provided in a "barrier layer" which provides a plurality of ink reservoirs. These reservoirs are located between a corresponding plurality of resistive heater elements, usually provided by a thin film structure, and a corresponding plurality of orifices (which are effectively nozzles), provided by an "orifice plate".

Thus orifice plates with multiple orifices aligned with thin film resistors are used to control the trajectory, drop weight and drop velocity of ink drops. Typically, these orifice plates are manufactured by electroforming processes and the metal that is commonly used is Nickel. Details of such metallic orifice plates and the functioning and manufacture of thermal inkjet printheads with orifice plates are described in the Hewlett-Packard Journal, Vol. 36, No.5, May 1985 and in U.S. Pat. No. 4,694,308 issued to C. S. Chan et al.

Use of plastic materials to fabricate orifice plates has certain advantages over metallic orifice plates. Some of the advantages of these plastic orifice plates are described in U.S. Pat. No. 4,829,319 issued to C. S. Chan et al. These include low cost of the orifice plates, transparency of the orifice plate which helps in viewing the fluid dynamics in the print cartridges, corrosion resistance to ink chemicals and the possibility of forming integral barrier layers on the thin film resistors.

U.S. Pat. No. 4,829,319 to Chan et al (hereafter US '319) discloses a plastic orifice plate for an inkjet printhead and manufacturing process therefor which includes electroforming a metal die having raised sections thereon of predetermined centre-to-centre spacings, and using the die to punch out openings in a plastic substrate of a chosen thickness to form a plurality of closely spaced orifice openings in the substrate. However the process of US '319 has a number of problems associated with it. First, it is difficult to preserve the structural integrity of thin plastic sheets during the die stamping operation. The thin plastic sheets are difficult to handle and are susceptible to tearing. Second, for most inkjet printing applications, a dimensional accuracy within submicron range is needed for the orifices and the US '319 process may not give this level of accuracy. Third, the shape of the orifices is important in controlling the directionality of ink droplets and it is difficult to achieve a perfect shape definition with the US '319 die stamping process. Fourth, the latest printheads require a high density of orifices in an orifice plate. This requires spacing consecutive orifices a distance of less than 10 microns apart, which spacing cannot be easily achieved using the US '319 process. Fifth, the US '319 process is rather complex involving many process steps, which may result in low yields in the process.

SUMMARY OF THE INVENTION

An object of the present invention is to provide a process for manufacturing plastic orifice plates which reduces at least some of the above problems. The invention includes providing a plastic orifice plate as such and also providing an inkjet printhead assembly which incorporates a plastic orifice plate.

The invention involves the use of a photoimageable polymer and photolithography for forming a plastic orifice plate having a defined pattern of orifices therein.

In another aspect, in forming an inkjet printhead assembly, a thin film resistor structure having a plastic barrier layer is provided and a formed plastic orifice plate is bonded thereto using heat and pressure.

Use of a photolithographic technique according to the invention allows use of a substrate to support a photoimageable polymer layer for the photolithographic steps, thereby avoiding the problem of damaging the plastic sheets as in US '319. Photolithography also allows for greater accuracy in the final product, both dimensionally and in orifice shapes, than is achievable in the US '319 process. The invention also involves less process steps compared to the US '319 process and thus should result in higher process yields.

For a better understanding of the invention and to show how it may be performed, embodiments thereof will now be described, by way of non-limiting example only, with reference to the accompanying drawings.

DETAILED DESCRIPTION

Figure 1A:
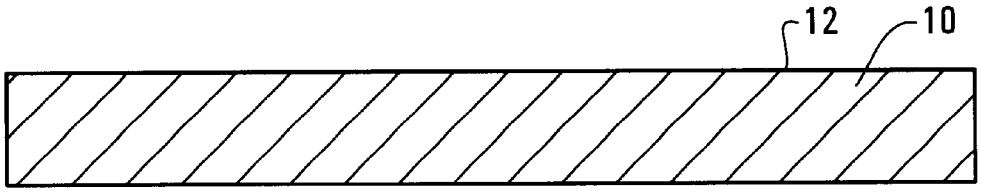
FIGS. 1A to 1H are schematic cross-sectional views of steps in a preferred process for forming a plastic orifice plate according to the invention.
Figure 1B:
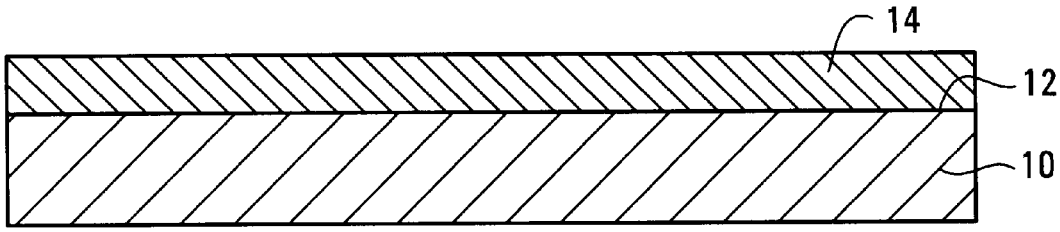

With reference to FIGS. 1A to 1H, a surface 12 of a standard six inch silicon wafer substrate 10 for supporting a photoimageable polymer for forming a plastic orifice plate is first coated with a layer 14 of metal, which may be gold, tantalum/gold, or chromium/stainless steel, to a thickness of about 2000 Angstrom by a vacuum deposition process (see FIG. 1B). Layer 14 acts as a seed layer for the subsequent electro-deposition of a Nickel layer 16. Nickel layer 16 is electro-deposited to a thickness of about 5 microns in a Watts' bath containing Nickel Sulphate, Nickel Chloride and Boric Acid in an aqueous solution along with organic additives such as saccharin, Aromatic Sulphonic acids, Sulfonamides and Sulphonimides. The Nickel layer 16 provides the required surface energy for the adhesion of a plastic material (from which the orifice plate is to be formed) during a lamination process onto the substrate 10 and it facilitates the release of the subsequently formed plastic orifice plate.

Figure 1C:
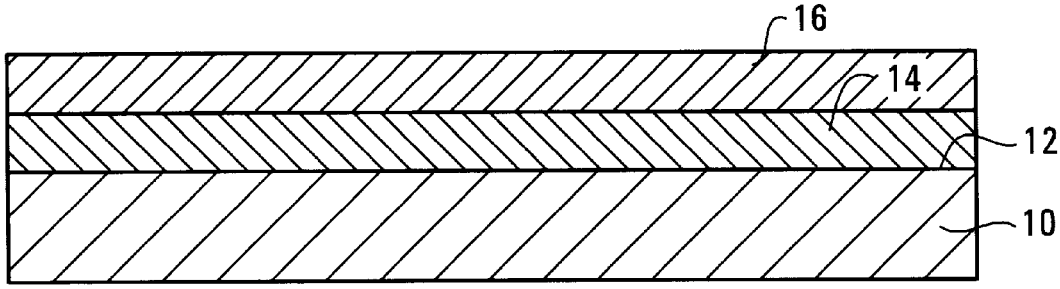
Figure 1D:
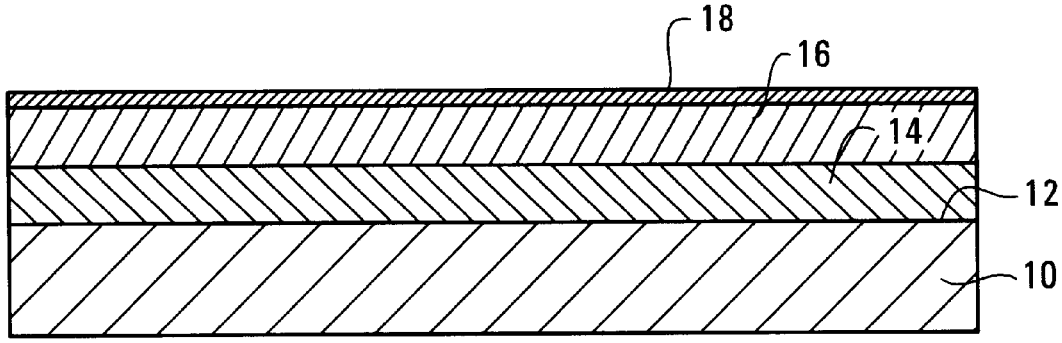

The silicon wafer 10 of FIG. 1C is preferably treated with an aqueous solution containing 30% Nitric acid and 4% Hydrogen peroxide for 30 seconds to increase the surface roughness (see Ref. 18 in FIG. 1D) of the Nickel layer 16 depending on the exposure time. Typically for a 30 second exposure an increase in surface roughness of around 20% can be observed. For example, the measured values of surface roughness from a Digital Instrumental Atomic Force microscope on the Nickel layer 16 before and after the acid treatment are 11.22 nm and 14.15 nm respectively. Such surface treatment by acid is found to increase the adhesion of a polymer material to the Nickel layer 16. Thus the substrate 10 is provided having a surface with predetermined characteristics.

Figure 1E:
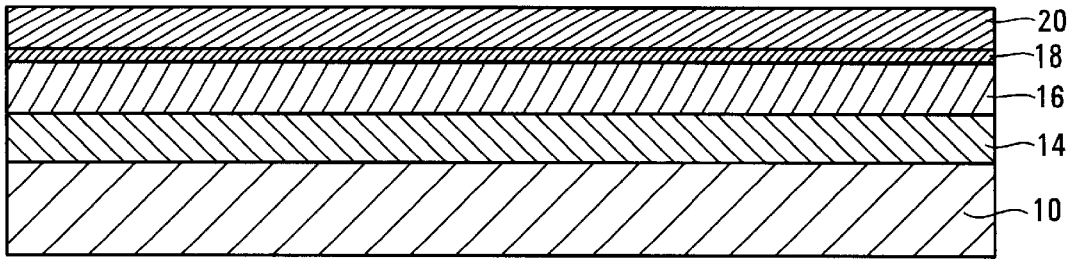

With reference to FIG. 1E, a layer 20 of a photoimageable polymer material of about 25 microns thickness is then provided on the surface 18 of substrate 10. Polymer 20 may be a solid film which is pasted onto the substrate 10 either manually or using a standard laminating machine. Alternatively the polymer may be supplied as a liquid and spun onto substrate 10 using a spin coating machine. A photoimageable polymer includes three major components: a photo active compound that undergoes cross-linking polymerization reaction on exposure to the suitable radiation, a photo packaging compound that initiates the radical polymerization and a solvent or a binder that carries both the photo active and photo packaging compounds either in a liquid or in a solid form. In the present invention the photoimageable polymers referred by their trade names IJ5000 series Barrier material and SU-8 photoresists have been used. These chemicals are supplied by DuPont and Microchem companies respectively. Photoimageable polymers with the composition given below are suitable for the fabrication of orifice plates.

Photo active compounds: Methacrylate esters, Urethane derivatives and Epoxy derivatives.

Photo packaging compounds: Aryl sulfonium salts

Solvents and Binders: Polymethyl metacrylate, γ-Butyrolactone

Figure 1F:
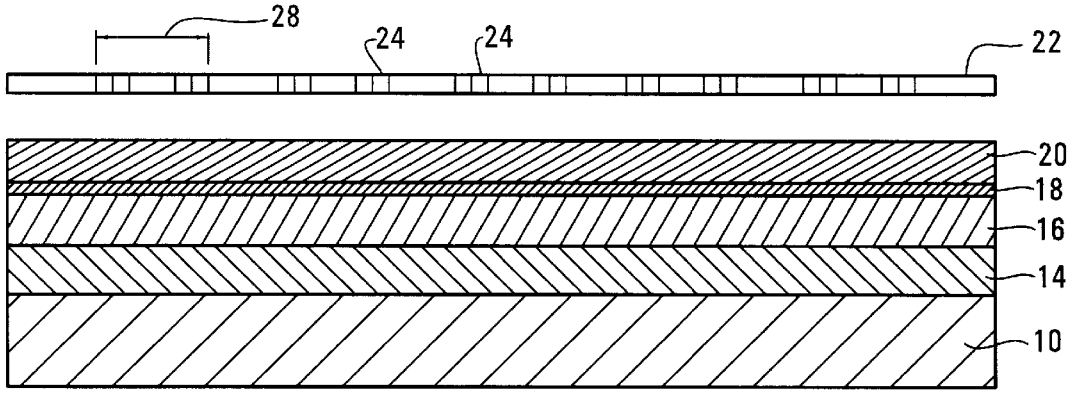

A mask 22 which defines a required pattem of orifices 24 for the orifice plate is then provided (see FIG. 1F). The mask 22 and silicon substrate 10 of the figures encompasses a number of "dies", that is, they provide for simultaneous fabrication of a number of orifice plates, thus the mask 22 also provides a required pattern of orifice plates.

Figure 1G:
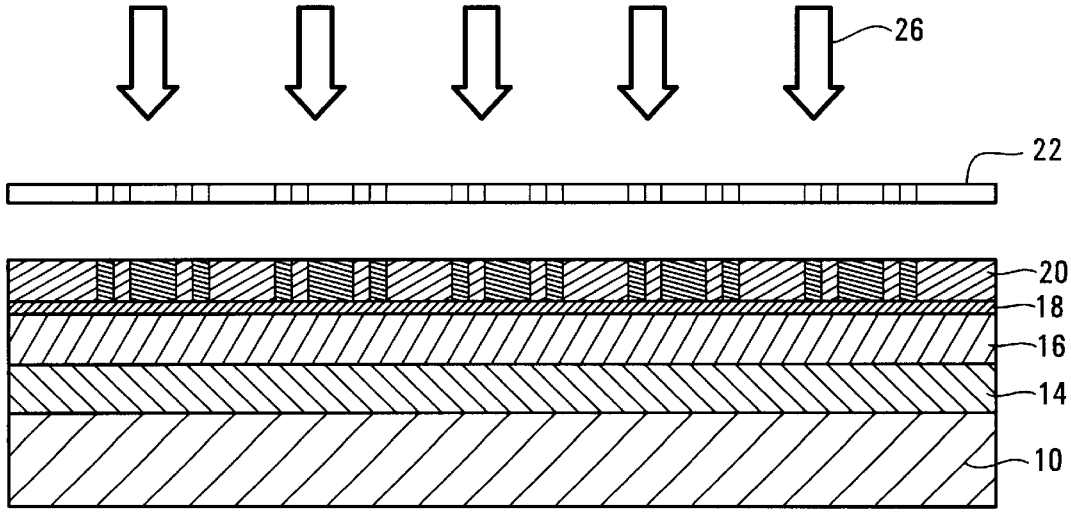

Mask 22 is appropriately aligned relative to substrate 10 and the photoimageable polymer layer 20 is then exposed to ultra-violet (UV) radiation 26 through mask 22 (see FIG. 1G). Under typical operating conditions, an expose energy of 45 mJoules/$cm^2$ may be used. The expose energy can be varied between 40 to 600 mJoules/$cm^2$ depending on the nature of the polymer film used in the fabrication process. Instead of a single polymer layer 20 a dual polymer film coating using two different types of polymers to increase the total polymer layer thickness to 60 microns may be used. The main reason for using a dual polymer film is to increase the thickness of the plastic orifice plate. The typical thickness range of the orifice plates is between 20 to 60 microns while most of the commercially available photoimageable polymers are about 25 microns thick. Hence for orifice plates requiring higher thickness, it is necessary to coat more than one layer to attain the required thickness.

Figure 1H:
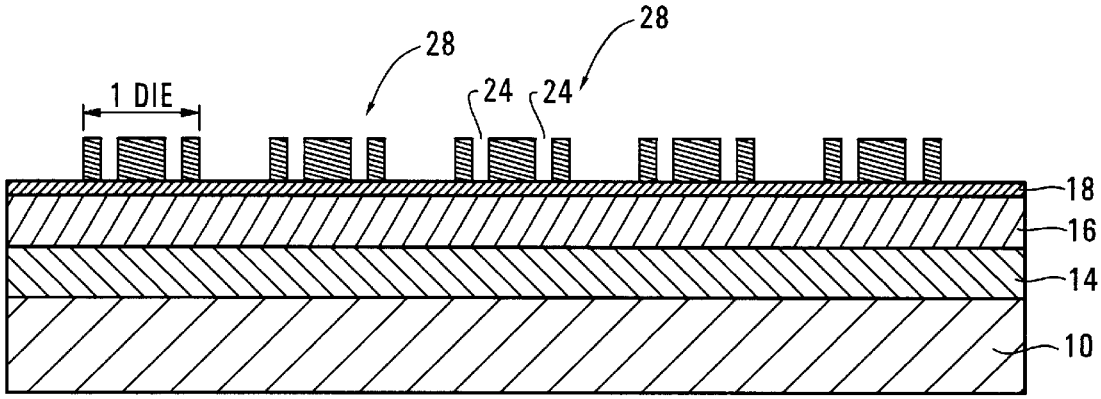

After the expose step, the polymer layer 20 is then developed using a suitable solvent such as a solution of N-methyl pyrrolidone and Diethylene Glycol resulting in a pattern of orifice plates 28 on the substrate 10 (see FIG. 1H). The developing solvent can be a solution with a concentration of N-methyl pyrrolidone in the range of 50% v/v to 75% v/v and with Diethylene Glycol up to a concentration of 26% v/v. The plastic orifice plates 28 on the silicon wafer substrate 10 are then cured with UV radiation to complete the fabrication process.

Figure 2:
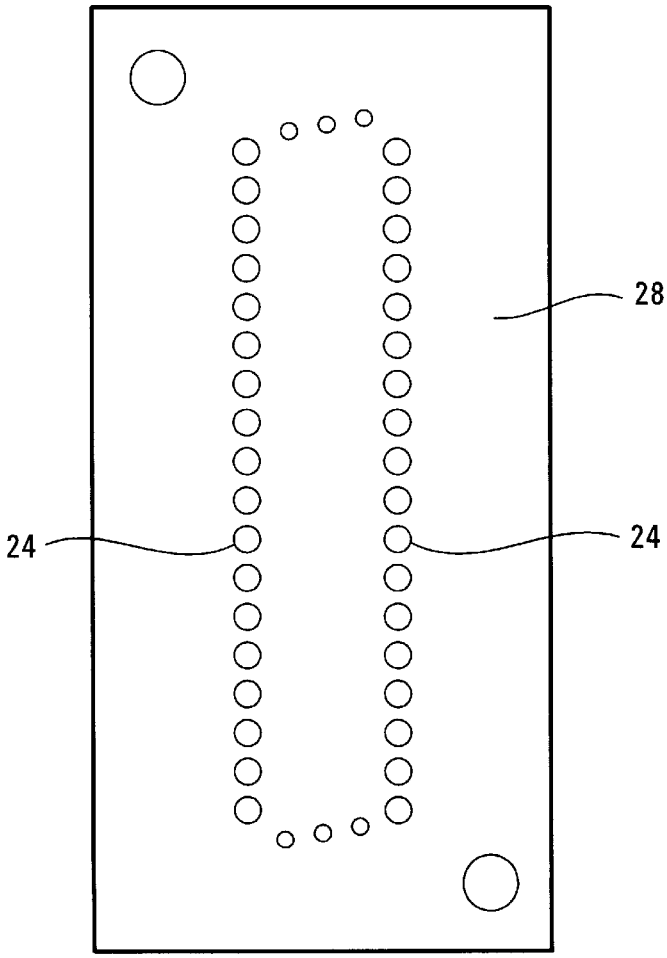
FIG. 2 is a plan view of an orifice plate formed using the steps of FIGS. 1A to H.

FIG. 2 shows a plan view of an orifice plate 28 with orifices 24.

The adhesion of the plastic orifice plates 28 thus fabricated to the Nickel layer 16–18 on the silicon wafer substrate 10 is very strong at this stage. In order to release the orifice plates 28 from the substrate 10 for subsequent processing, the Nickel layer 16–18 is oxidised by a "dip" step. In this step, the substrate 10 with plastic orifice plates 28 is dipped in a solution of pH 4 and at a temperature of 55° C. for 15 minutes. Operating conditions for the "dip" process for the pH can vary between 2 to 5 and for the solution temperature between 50° C. to 70° C. The Watts' bath solution described hereinbefore may be used for this "dip" step, which is for oxidizing the surface 18 of Nickel layer 16 for weakening the Nickel 16-barrier material 22 adhesion. The plastic orifice plates 28 after this dip step can be released from the silicon wafer substrate using a blue sticky tape.

Subsequent processing steps to form an inkjet printhead assembly involve attaching an orifice plate 28 to a thin film structure, which structure provides a plurality of resistive heater elements. Such a thin film structure will have a plastic barrier layer thereon which defines ink reservoirs aligned over the resistive heater elements. Provision of such a thin film structure having a plastic barrier layer is known. Two methods for attaching an orifice plate 28 to such a thin film structure are shown in FIGS. 3A to 3C and FIGS. 4A to 4C respectively.

Figure 3A:
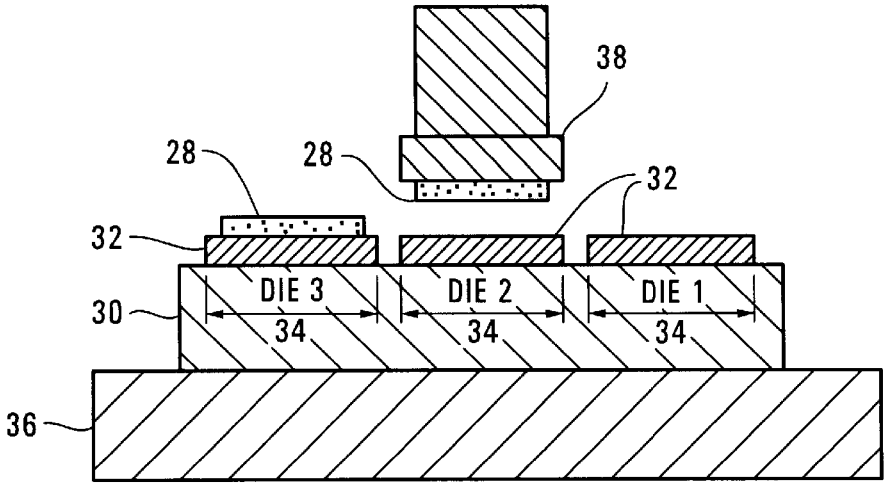
FIGS. 3A to 3C schematically illustrate in cross section further process steps for forming an inkjet printhead assembly involving attaching the orifice plate of FIG. 2 onto a thin film resistor wafer.
Figure 3B:
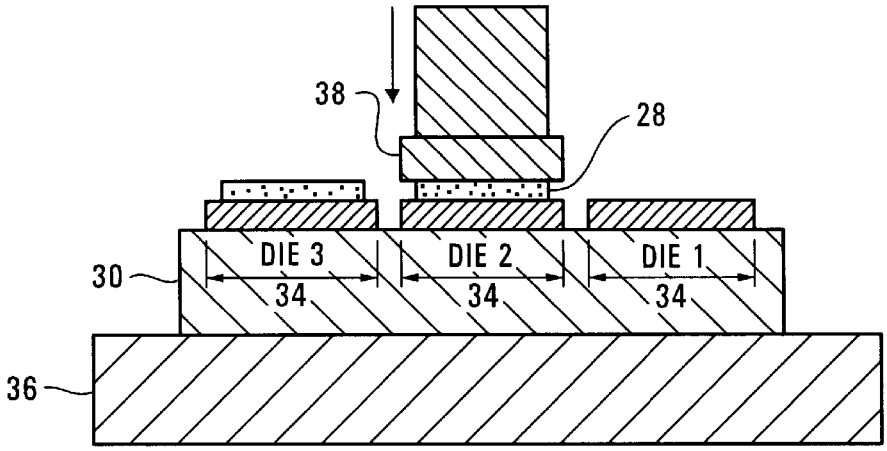
Figure 3C:
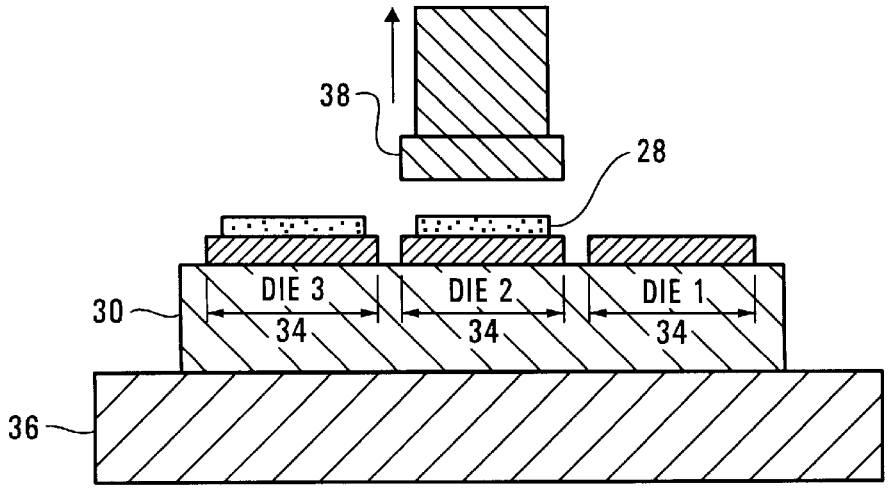
Figure 4A:
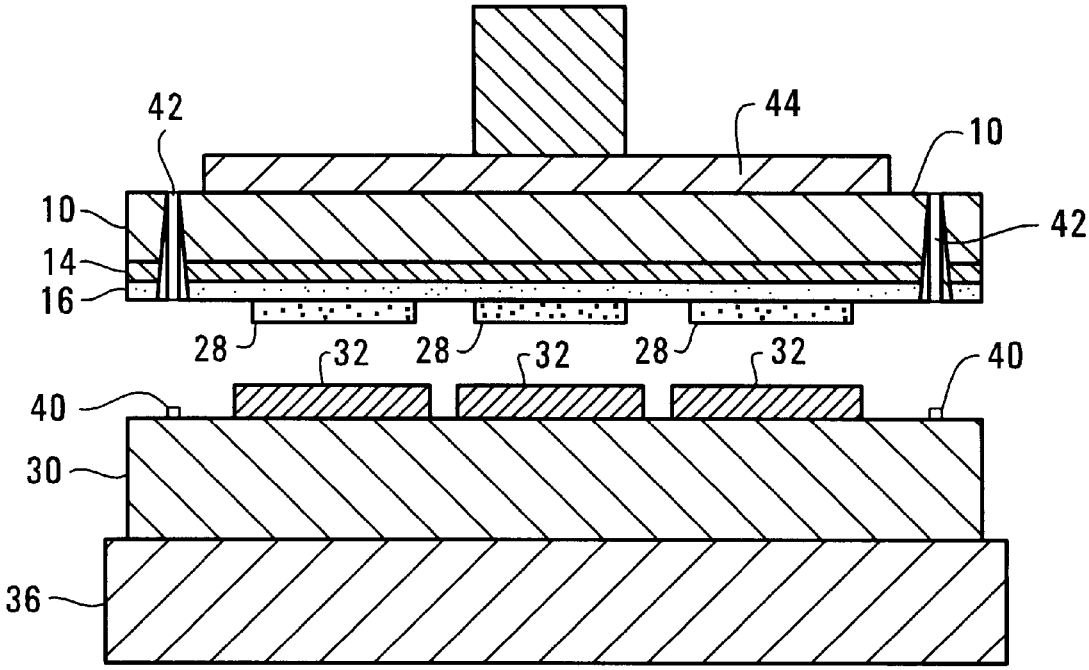
FIGS. 4A to 4C illustrate alternative process steps to those of FIGS. 3A to 3C.
Figure 4B:
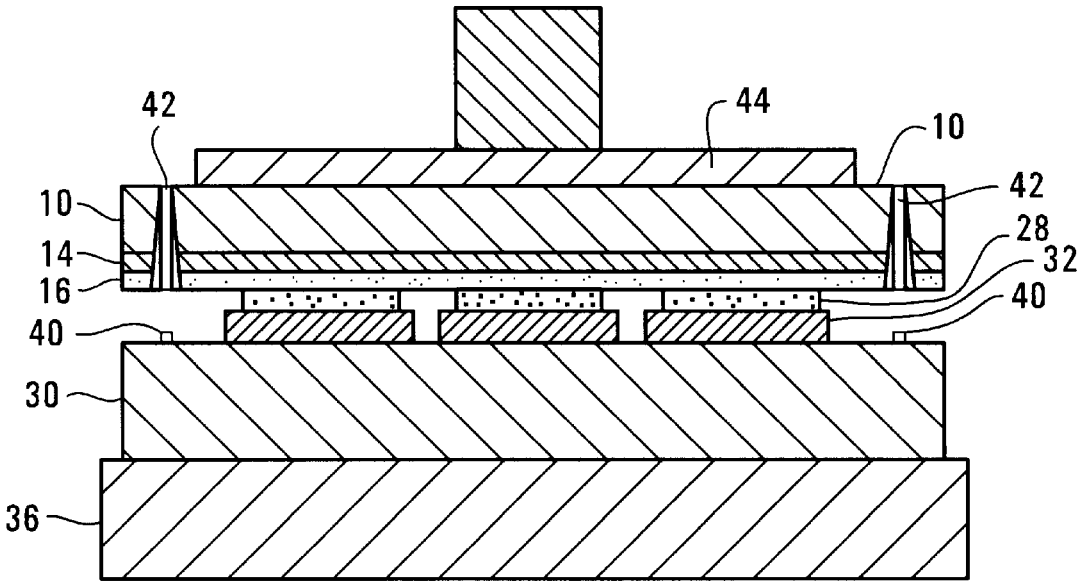
Figure 4C:
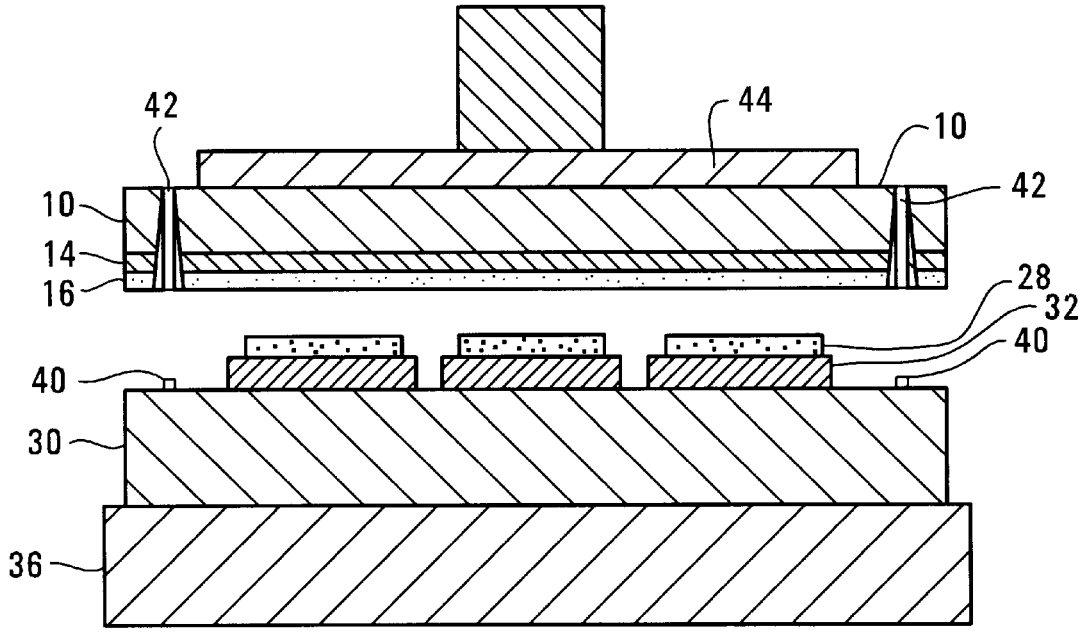

With reference to FIGS. 3A to 3C, orifice plates 28 are singly attached to a thin film resistor structure 30 which is a wafer. Each orifice plate 28 is attached onto a barrier layer 32 of each die pattern 34 of thin film wafer 30. This is done by placing thin film wafer 30 on a heater chuck 36 for heating the barrier layers 32 to a temperature above the glass transition temperature Tg of the barrier layer 32 which is about 90° C. The barrier layer 32 material comprises two main components, a thermoplastic component and a thermoset component. Above the temperature Tg, the thermoplastic component starts to soften and causes the barrier layer 32 to get sticky. A plastic orifice plate 28 is brought above a die 34 of thin film wafer 30 and is aligned with the die pattern on the thin film wafer (see FIG. 3A). Once aligned the orifice plate 28 is pressed onto the die 34 and barrier layer 32 using a place chuck 38 (see FIG. 3B). As the barrier layer 32 is above its Tg temperature, the plastic orifice plate 28 will bond to the barrier layer 32 due to the pressure applied by place chuck 38. The place chuck 38 is then retracted (see FIG. 3C) to proceed to the next plastic orifice plate 28 and die 34.

With reference to FIGS. 4A to 4D, a wafer to wafer attachment method involves (as in FIG. 3) placing the thin film wafer 30 having barrier layers 32 on a heater block 36 and heating to above the glass transition temperature Tg of the barrier layer 32 material. However, in this method the silicon substrate 10 and attached plastic orifice plates 28 of FIG. 1H (after the oxidation step) is positioned above the thin film wafer 30 for alignment. The alignment can be done by using a pair of matching patterns on the thin film wafer 30 and the silicon wafer 10, with that on the silicon wafer 10 being associated with an etched "see through" hole—as indicated at 40 and 42. Once aligned, the silicon wafer 10 with plastic orifice plates 28 is pressed via place chuck 44 onto the barrier layers 32 of thin film wafer 30. Upon withdrawal of place chuck 44 and because the adhesion between the Nickel layer 16 and the plastic orifice plates 28 is weaker than that between the barrier layer 32 and the plastic orifice plates 28, the silicon wafer 10 gets separated from the plastic orifice plates 28 leaving them attached to barrier layer 32 (see FIG. 4D). Inkjet printhead assemblies are then provided by removing the thin film wafer 30 from heater chuck 36 and individualizing the thin film dies.

Using the above described process steps, plastic orifice plates having diameters less than 25 microns with size distributions within one micron, and having a pitch between orifices of less than 10 microns, can be provided. Important features of the orifices, such as their shapes, can be controlled to sub-micron accuracy. The invention includes providing orifice plates having different orifice shapes, both circular and non-circular.

By choosing the same material for the plastic orifice plates 28 and for the barrier layers 32 of the thin film resistor structure 30, the adhesion and corrosion resistance properties of the thin film dies 34 can be improved.

What is claimed is:

1. A process for forming an orifice plate for an inkjet printhead comprising:

providing a layer of a photoimageable polymer, providing a mask which defines a required pattern for orifices of the orifice plate, exposing the layer of photoimageable polymer to radiation through the mask, developing the photoimageable polymer using a suitable solvent, and curing the remaining photoimageable polymer of the layer thereof whereby said remaining layer forms the orifice plate having a defined pattern of orifices.

2. A process as claimed in claim 1 including providing a substrate having a surface with predetermined characteristics and providing the layer of a photoimageable polymer on this surface, the surface characteristics being such that the polymer adheres thereto and is subsequently separable therefrom.

3. A process as claimed in claim 2 wherein the substrate is a semi-conductor material and a surface thereof is plated with metal to provide said surface with predetermined characteristics.

4. A process as claimed in claim 3 wherein the substrate is silicon and the metal plated thereon is a vacuum deposited layer of a suitable metal onto which a Nickel layer is electrodeposited.

5. A process as claimed in claim 4 wherein the vacuum deposited layer of a suitable metal is selected from the group consisting of tantalum/gold, chromium/stainless steel and gold.

6. A process as claimed in claim 4 wherein the Nickel layer is treated to increase its surface roughness thereby forming said surface with predetermined characteristics.

7. A process as claimed in claim 2 wherein following the curing step, the surface of the substrate having predetermined characteristics is treated for separating the polymer therefrom.

8. A process as claimed in claim 2 further including attaching the orifice plate to a polymer barrier layer of a thin film structure, wherein the thin film structure provides a plurality of resistive heater elements, the barrier layer defining a plurality of ink reservoirs overlying the resistive heater elements, and the orifice plate being aligned with the barrier layer such that its defined pattern of orifices respectively overlie the ink reservoirs, the orifice plate being attached to the polymer barrier layer by heating the polymer barrier layer and pressing the substrate relatively towards the thin film structure with the aligned orifice plate in facing contact with the polymer barrier layer until the orifice plate and the polymer barrier layer form a bond which is stronger than the adhesion between the substrate and the polymer orifice plate, and subsequently removing the substrate.

9. A process as claimed in claim 1 wherein the photoimageable polymer material comprises of a photoactive compound, a photo packaging compound and a solvent or binder and the radiation it is exposed to is ultraviolet radiation.

10. A process as claimed in claim 9 wherein the barrier layer is a polymer film, and the orifice plate is attached thereto by heating the polymer film and relatively pressing the orifice plate onto it.

11. A process as claimed in claim 1 further including attaching the orifice plate to a barrier layer of a thin film structure, wherein the thin film structure provides a plurality of resistive heater elements, the barrier layer defining a plurality of ink reservoirs overlying the resistive heater elements, and the orifice plate being aligned with the barrier layer such that its defined pattern of orifices respectively overlie the ink reservoirs.

12. A process for forming a thermal inkjet printhead assembly comprising forming a polymer orifice plate having a defined pattern of orifices therein, wherein the polymer is photoimageable and the orifices are formed using a photolithographic technique and developing the photoimageable polymer, bonding the polymer orifice plate to a polymer barrier layer of a thin film resistor structure such that individual orifices of the orifice plate respectively overlie an ink reservoir and associated resistive heater element provided by the barrier layer and the thin film resistor structure.

13. A process for forming a thermal inkjet printhead assembly comprising forming a polymer orifice plate having a defined pattern of orifices therein, bonding the polymer orifice plate to a polymer barrier layer of a thin film resistor structure such that individual orifices of the orifice plate respectively overlie an ink reservoir and associated resistive heater element provided by the barrier layer and the thin film resistor structure, wherein the polymer orifice plate is bonded to the polymer barrier layer using heat and pressure.

14. A thermal inkjet printhead assembly comprising a thin film structure which provides a plurality of resistive heater elements, a polymer barrier layer on the thin film structure which defines a plurality of ink reservoirs respectively overlying the resistive heater elements, a polymer orifice plate having a plurality of orifices formed therein and which is heat and pressure bonded to the polymer barrier layer with the orifices respectively overlying the ink reservoirs.

15. A thermal inkjet printhead assembly as claimed in claim 14 wherein the polymer barrier layer and the polymer orifice plate are the same polymer material.

* * * * *